US007114438B2

(12) United States Patent
Kolbe et al.

(10) Patent No.: US 7,114,438 B2
(45) Date of Patent: Oct. 3, 2006

(54) PRINTING MACHINE INCLUDING CENTRAL IMPRESSION CYLINDER

(75) Inventors: Wilfried Kolbe, Gülzow (DE); Bodo Steinmeier, Bielefeld (DE); Andreas Kückelmann, Ibbenbüren (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 10/860,719

(22) Filed: Jun. 3, 2004

(65) Prior Publication Data

US 2005/0000377 A1 Jan. 6, 2005

(30) Foreign Application Priority Data

Jul. 3, 2003 (EP) ..... 03015093

(51) Int. Cl.
*B41F 13/18* (2006.01)

(52) U.S. Cl. ..... 101/216; 101/480; 492/47; 492/59

(58) Field of Classification Search ..... 101/216, 101/217, 375, 376, 480, 212; 492/47, 48, 492/59

See application file for complete search history.

(56) References Cited

U.S. PATENT DOCUMENTS 4,963,210 A * 10/1990 Corr et al. ..... 156/172
5,061,533 A * 10/1991 Gomi et al. ..... 428/36.3
5,191,486 A * 3/1993 Sato et al. ..... 359/894
6,523,470 B1 2/2003 Kolbe et al.
6,672,028 B1 * 1/2004 Henninger ..... 52/720.1
6,701,838 B1 3/2004 Kolbe et al.
2001/0013288 A1 * 8/2001 Kolbe et al. ..... 101/150
2002/0056387 A1 * 5/2002 Kolbe et al. ..... 101/375

FOREIGN PATENT DOCUMENTS

| | | |
|---|---|---|
| DE | 31 31 059 | 3/1982 |
| EP | 0 150 047 | 7/1985 |
| EP | 0 385 948 | 9/1990 |

OTHER PUBLICATIONS

Patent Abstracts of Japan, vol. 017, No. 300, Publication No. 05024174, Jun. 8, 1993.

* cited by examiner

*Primary Examiner*—Leslie J. Evanisko
(74) *Attorney, Agent, or Firm*—Richard M. Goldberg

(57) ABSTRACT

Printing machine having at least one impression cylinder (16), characterised in that the impression cylinder (16) has a cylinder body (44) made of a material which, in circumferential direction of the impression cylinder (16) has a linear thermal expansion coefficient of less than $2\times10^{-6}\,K^{-1}$. The material may be a composite material, for example, a material containing carbon fibers, in particular a synthetic resin reinforced with carbon fibers.

20 Claims, 2 Drawing Sheets

PRINTING MACHINE INCLUDING CENTRAL IMPRESSION CYLINDER

BACKGROUND OF THE INVENTION

The invention relates to a printing machine having at least one impression cylinder.

An impression cylinder is used for example in a flexographic printing press for pressing the print substrate against a printing cylinder. In this case, the print substrate is conventionally guided around the impression cylinder and is advanced by this cylinder. In order for the printing ink to be precisely transferred from the printing cylinder onto the print medium at the location of contact between the impression cylinder and the printing cylinder, it is necessary to precisely adjust an optimal distance between the cylinders, in order to achieve a printed image with a uniform high quality which meets the high quality standards that are commonly required today.

The diameter of the impression cylinder may for example be in a range from 2 m to 3.5 m. Given a linear thermal expansion coefficient of about $11\times10^{-6}$ $K^{-1}$ for steel, a fluctuation of the temperature of the impression cylinder by 5° C. results in a change in the external radius by an amount of approximately 55 μm to 95 μm. For this reason, a temperature stabilisation is applied in conventional printing machines in order to avoid inadmissible fluctuations in the radius of the impression cylinder. Thus, steel impression cylinders are known which have a two-fold external steel wall the interstice of which serves as a channel for tempering water.

When, for example, the environmental temperature in a print shop fluctuates between 15° C. and 35° C., a tempering system of the liquid coolant type permits to limit the temperature fluctuation of the impression cylinder to ±0.5° C. or ±1° C., whereby the necessary dimensional stability of the radius of the impression cylinder is assured.

SUMMARY OF THE INVENTION

It is an object of the invention to provide a printing machine in which the dimensional stability of an impression cylinder, which is necessary for a high print quality, can be achieved with simpler means.

According to the invention, this object is achieved with a printing machine of the type described above, in which the impression cylinder has cylinder body made of a material that, in circumferential direction of the impression cylinder, has a linear thermal expansion coefficient of less than $2\times10^{-6}$ $K^{-1}$. Then, the thermal expansion coefficient of the material determines the thermal expansion of the impression cylinder.

In an impression cylinder having this construction and having a diameter of 2 m, for example, the deviation of the external radius for a temperature change of 5° C. is smaller than 10 μm. Thus, an internal tempering system of the impression cylinder can be dispensed with, when the environmental temperature in the print shop is kept at a sufficiently constant level. Depending on the field of application, a larger deviation of the external radius may be acceptable for higher temperature changes. In these cases, a tempering system employing a coolant circulating through the impression cylinder may be dispensed with.

Preferably, however, a material is employed the linear thermal expansion coefficient of which in said circumferential direction is even smaller than $1\times10^{-6}$ $K^{-1}$, more preferably smaller than $0.5\times10^{-6}$ $K^{-1}$. The smaller the thermal expansion coefficient is, the smaller is the need for temperature control measures, and the larger are the temperature fluctuations in the print shop that may be tolerated while still assuring a high print quality. Thus, when a material having a linear thermal expansion coefficient of $0.45\times10^{-6}$ $K^{-1}$ is used, and it is assumed that the environmental temperature in the print shop varies in a range from 15° C. to 35° C., a dimensional stability of the impression cylinder is achieved which is even better than that of a steel impression cylinder with temperature control to ±0.5° C. By eliminating the liquid coolant system, the construction of the printing system is simplified, and, in addition, energy savings are achieved in operation.

When, in the following, a preferred range of less than $2\times10^{-6}$ $K^{-1}$ is occasionally mentioned for the linear thermal expansion coefficients, it still applies that a value of less than $1\times10^{-6}$ $K^{-1}$ is more preferable and a value of less than $0.5\times16^{-6}$ $K^{1}$ is particularly preferred. In general, it is advantageous to have a thermal expansion coefficient as close to zero as possible.

Preferred embodiments of the invention are indicated in the dependent claims.

Preferably, a part of the impression cylinder which radially supports the cylinder body from inside is made of a material which has, in this direction, a linear thermal expansion coefficient less than $2\times10^{-6}$ $K^{-1}$.

In a particularly preferred embodiment, the cylinder body is a cylindrical sleeve, and the part of the impression cylinder which radially supports the cylinder body from inside is formed by disks. Spokes in place of disks are also conceivable.

Due to the small thickness of the sleeve in comparison to the radius of the impression cylinder, the radial expansion coefficient of the material of which the sleeve is predominantly formed contributes only very little to a temperature-dependent change of the external radius of the impression cylinder. A material having an unisotropic thermal expansion coefficient can therefore be used in a particularly advantageous way; for example, the sleeve may be made of synthetic resin reinforced with carbon fibers, wherein the fibers are wound in circumferential direction of the sleeve and are embedded in a matrix of synthetic resin. The linear thermal expansion coefficient in circumferential direction of the sleeve may then be equal to zero.

The impression cylinder preferably has an axle which is predominantly made of a material having a linear thermal expansion coefficient of less than $2\times10^{-6}$ $K^{-1}$ in circumferential and/or radial direction of the axle. The axle carries the part of the impression cylinder which supports the cylinder body radially from inside, such as the disks, for example.

Preferably, the material having the linear thermal expansion coefficient of less than $2\times10^{-6}$ $K^{-1}$ is a composite material, especially a fiber composite material. It is also possible to use different composite materials for the various parts of the impression cylinder. Likewise is it possible to combine a composite material with other materials. As an alternative, the impression cylinder may be formed in one piece.

The composite material is preferably a material containing carbon fibers, preferably a carbon fiber-reinforced synthetic resin. Composite materials of this type are disclosed, for example, in U.S. Pat. Nos. 6,523,470 and 6,701,838. With such a material, it is possible that the impression cylinder has a self-supporting sleeve which, due to its intrinsic rigidity, keeps the deformations of the impression cylinder occurring during printing within the admissible tolerance limits. Thanks to the relatively low specific weight of this type of material the total weight and the moment of inertia of the sleeve remains relatively low, which is favourable for the running smoothness of the printing machine.

Through a uniform use of material such that the thermal expansion coefficient in each of the said relevant directions is limited as described, the occurrence of mechanical strains is avoided. Yet, the carbon fibers may have specific orientations, as was described above.

The cylinder body is preferably made of a carbon fiber composite material having a wound structure of carbon fibers.

In addition to the materials indicated above, polymer concrete or mineral casting may be used for manufacturing the impression cylinder. When an appropriate manufacturing method is employed, this material may have the required mechanical properties, in particular a thermal expansion coefficient, possibly direction-dependent, which is smaller that that of steel. The advantages are the same as with the use of the materials indicated above. It will be understood that other appropriate composite materials, especially fiber composite materials may also be used for manufacturing the impression cylinder.

BRIEF DESCRIPTION OF THE DRAWINGS

An embodiment example of the invention will now be explained in conjunction with the drawing, in which.

DETAILED DESCRIPTION

Figure 1:
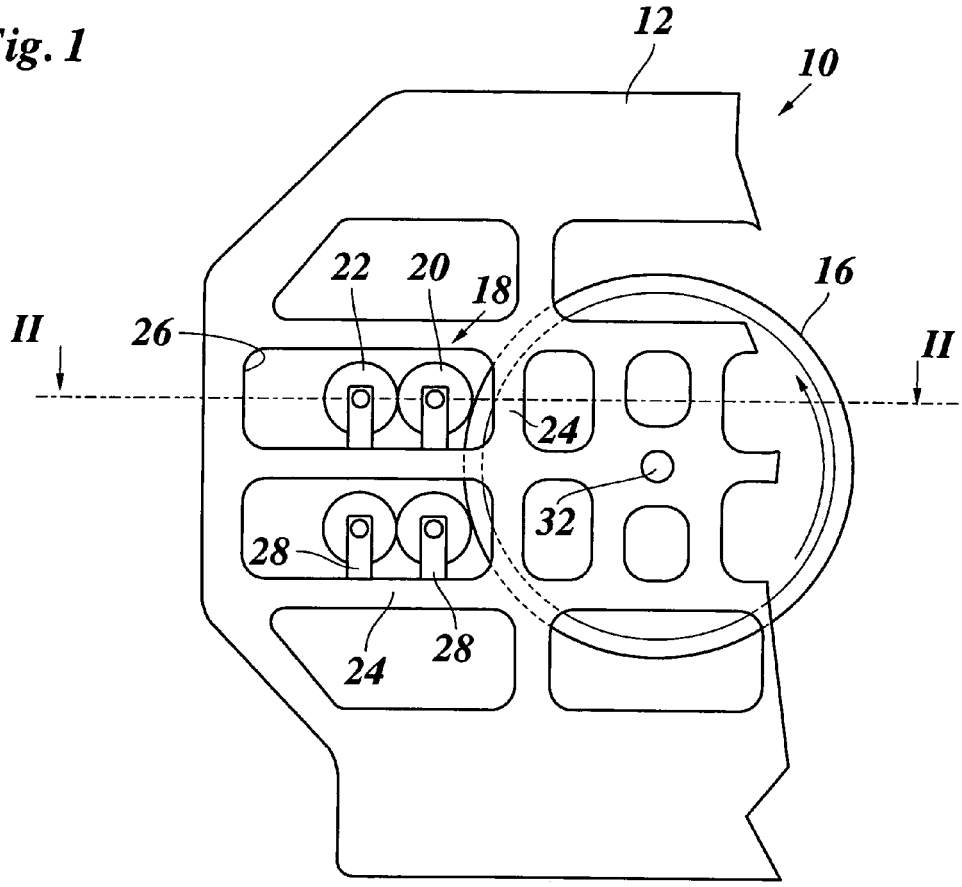
FIG. 1 is a side-elevational view of a part of a printing machine.
Figure 2:
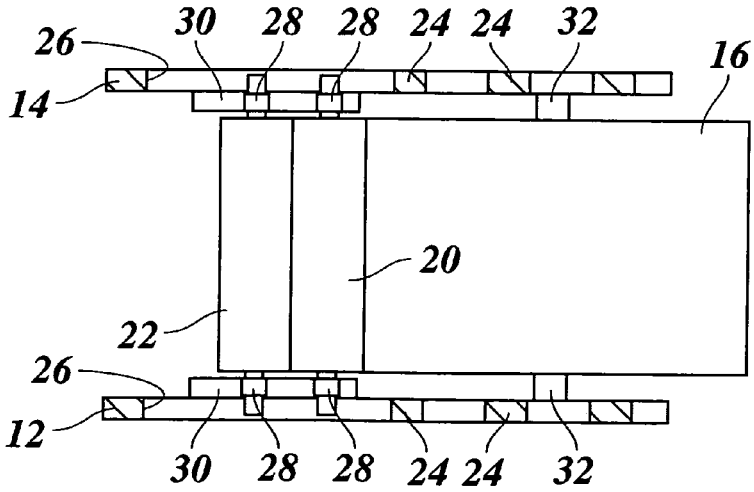
FIG. 2 is a cross-section along the line II—II in FIG. 1.

FIG. 1 is a view of a part of a flexographic printing machine. FIG. 2 shows a section along the line II—II in FIG. 1. The printing machine has a frame 10 which comprises two side members 12 and 14. Only the side member 12 is visible in FIG. 1. An impression cylinder 16 is supported between the side members 12 and 14, and several inking units 18 are arranged along the periphery of the impression cylinder. Each inking unit 18 comprises a printing cylinder 20 and an inking roller 22. Each of the side members 12 and 14 has struts 24 with several windows 26 formed therebetween. The printing cylinders 20 and the inking rollers 22 are supported in slides 28 which an be displaced along guide rails 30. The guide rails 30 are respectively mounted below the corresponding window 26 on the internal sides of the side members 12 and 14, respectively. The impression cylinder 16 has axle studs 32 with which it is journalled in the side members 12 and 14.

Figure 3:
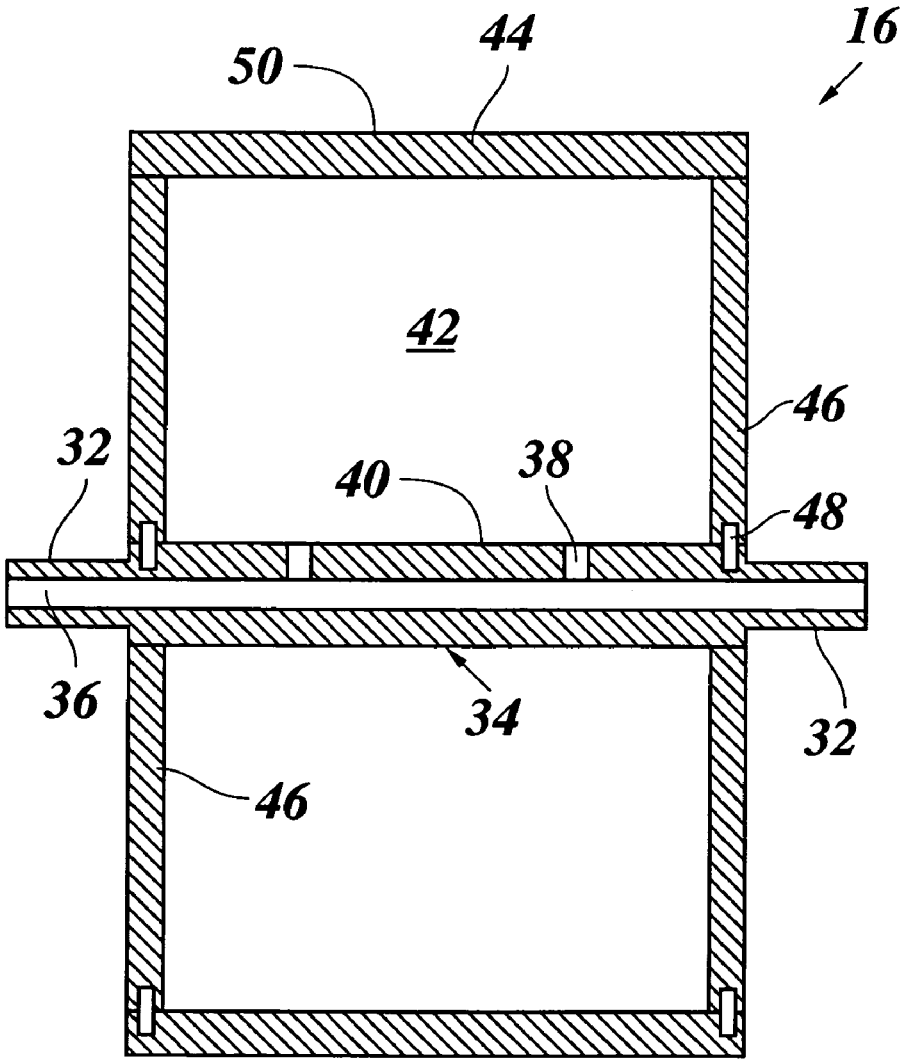
FIG. 3 shows an impression cylinder in longitudinal section.

The impression cylinder 16 which has been shown in longitudinal section in FIG. 3 has a cylinder core 34 made of carbon fiber-reinforced synthetic resin and forms a continuous axle with the axle studs 32 to be supported in the two side members 12 and 14 of the frame 10 being formed at both ends of the axle. Further, the cylinder core 34 has an axial bore 36 through which compressed air may be supplied, and which is in communication with an internal hollow space 42 of the impression cylinder through radial perforations 38 in the peripheral surface 40 of the cylinder core.

The cylinder core 34 is surrounded by a cylindrical sleeve 44 with a spacing, the sleeve being formed by a tubular body of carbon fiber-reinforced synthetic resin. Such tubular bodies made of carbon fiber composite material are already known per-se and have been used in printing machines, for example, as anilox rollers or as printing cylinders. Typically, these tubular bodies have a wound structure of carbon fibers that are embedded in a matrix of synthetic resin. The fibers are inclined at an appropriate angle of 10°, for example, relative to the circumferential direction, but may also have other orientations, such as diagonal, circumferential or longitudinal. The sleeve 44 is wound rotationally symmetric, so that its external diameter is approximately constant in case of temperature fluctuations. The sleeve 44 is manufactured with such a high precision that its external diameter has an accuracy of 5 μm.

Advantages of the use of carbon fiber-reinforced synthetic resins are their low specific weight, their high strength and stiffness and their small thermal expansion coefficient which is significantly smaller than $1\times10^{-6}$ $K^{-1}$ and is even approximately zero, depending on the direction.

The sleeve 44 is supported on the cylinder core 34 at both longitudinal ends by flat disks 46 which are also made of carbon fiber-reinforced synthetic resin. The disks 46 are rotationally rigidly connected to the cylinder core 34 as is symbolised by keys 48 in the drawing. Similarly, the sleeve 44 is rotationally rigidly connected to the disks 46, so that the cylinder core 34, the disks 46 and the sleeve 44, together, form a rigid impression cylinder with bending and torsional stiffness. The radial forces which act upon the external surface 50 of the sleeve 44 during printing are introduced into the two disks 46 without substantial deformation of the sleeve 44. Since the force is introduced into the cylinder core 34 close to its axle studs 32, a bending deformation of the cylinder core 34 is largely avoided. Moreover, the bending stiffness of the impression cylinder 16 as a whole is increased by the shell-like construction.

The directions of the fibers in the composite material are in each case oriented such that the linear thermal expansion coefficient of the respective component part is smaller than $0.5\times10^{-6}$ $K^{-1}$ in those directions which are relevant for the total expansion of the impression cylinder. The relevant direction for the sleeve 44 is the circumferential direction, in parallel with the outer surface 50, and the relevant directions for the disks 46 and the cylinder core 34 are the directions lying in the plane of the disks. In summary, it is thus achieved that the radius of the outer surface 50 of the impression cylinder 16 is changed by less than 0.5 μm per meter radius for a temperature change of 1° C.

The internal side of the sleeve 44 is formed with reinforcement ribs (not shown) which extend in the circumferential direction. As an alternative, other directions for the reinforcement ribs are conceivable. The disks 46 may also have reinforcement ribs.

The internal side of the sleeve 44 is formed with reinforcement ribs (not shown) which extend in circumferential direction. As an alternative, other directions for the reinforcement ribs are conceivable. The disks 26 may also have reinforcement ribs.

By introducing compressed air through the axial bore 36, a high pressure can be created in the hollow space 42 between the cylinder core 34 and the sleeve 44. In this way, the sleeve 44 may be biased from inside, in order to influence its crown, if necessary.

Instead of or in addition to using keys 48 or other fitting parts for fixing the sleeve 44 to the disks 46, the sleeve may also be fixed by gluing or by other methods, or the sleeve 44 may be formed in one piece with the disks 46.

Unlike the shown embodiment, more than two disks 46 may be provided in the impression cylinder, and the disks 46 may also be offset inwardly in axial direction from both ends of the impression cylinder 16 relative to the sleeve 44.

The disks 46 and/or the cylinder core 34 may alternatively be made of a material different from that of the sleeve. Then, the thickness of the sleeve 44 should be sufficiently large to absorb strains that may result from thermal expansion of the disks 46, and the thicknesses of the disks 46 must be sufficiently large, respectively, in order to absorb the strains resulting from thermal expansion of the cylinder core. Preferably, however, the impression cylinder 16 has such a construction that no internal strains occur.

The invention claimed is:

1. Printing machine comprising:

a central impression cylinder, the central impression cylinder having a cylinder body made of a material which, in a circumferential direction of the central impression cylinder, has a linear thermal expansion coefficient of less than $2\times10^{-6}$ $K^{-1}$; and a plurality of printing cylinders arranged at a periphery of the central impression cylinder.

2. Printing machine according to claim 1, wherein the cylinder body is a cylindrical sleeve.

3. Printing machine according to claim 2, wherein the material, the linear thermal expansion coefficient of which is less than $2\times10^{-6}$ $K^{-1}$, is a composite material.

4. Printing machine according to claim 2, wherein the cylinder body is made of a carbon fiber composite material having a wound structure of carbon fibers.

5. Printing machine according to claim 1, wherein the material, the linear thermal expansion coefficient of which is less than $2\times10^{-6}$ $K^{-1}$, is a composite material.

6. Printing machine according to claim 5, wherein the composite material is a material containing carbon fibers.

7. Printing machine according to claim 6, wherein the composite material is a synthetic resin reinforced with carbon fibers.

8. Printing machine according to claim 1, wherein the cylinder body is made of a carbon fiber composite material having a wound structure of carbon fibers.

9. Printing machine having at least one central impression cylinder, each central impression cylinder having a cylinder body made of a material which, in a circumferential direction of the central impression cylinder, has a linear thermal expansion coefficient of less than $2\times10^{-6}$ $K^{-1}$, and the central impression cylinder includes a part which radially supports the cylinder body from inside, and the part is made of a material which, in a radial direction, has a linear thermal expansion coefficient of less than $2\times10^{-6}$ $K^{-1}$.

10. Printing machine according to claim 9, wherein the part of the central impression cylinder which supports the cylinder body radially from inside is formed by disks.

11. Printing machine according to claim 10, wherein the materials, the linear thermal expansion coefficients of which are less than $2\times10^{-6}$ $K^{-1}$, are composite materials.

12. Printing machine according to claim 10, further comprising an axle which carries the part of the central impression cylinder which supports the cylinder body radially from the inside, the axle being predominantly made of a material having, in at least one of the circumferential direction and radial direction of the axle, a linear thermal expansion coefficient of less than $2\times10^{-6}$ $K^{-1}$.

13. Printing machine according to claim 10, wherein the cylinder body is made of a carbon fiber composite material having a wound structure of carbon fibers.

14. Printing machine according to claim 9, further comprising an axle which carries the part of the central impression cylinder which supports the cylinder body radially from the inside, the axle being predominantly made of a material having, in at least one of the circumferential direction and radial direction of the axle, a linear thermal expansion coefficient of less than $2\times10^{-6}$ $K^{-1}$.

15. Printing machine according to claim 14, wherein the cylinder body is made of a carbon fiber composite material having a wound structure of carbon fibers.

16. Printing machine according to claim 14, wherein the materials, the linear thermal expansion coefficients of which are less than $2\times10^{-6}$ $K^{-1}$, are composite materials.

17. Printing machine according to claim 9, wherein the materials, the linear thermal expansion coefficients of which are less than $2\times10^{-6}$ $K^{-1}$, are composite materials.

18. Printing machine according to claim 9, wherein the cylinder body is made of a carbon fiber composite material having a wound structure of carbon fibers.

19. Printing machine having at least one central impression cylinder, each central impression cylinder having a cylinder body as a cylindrical sleeve made of a material which, in a circumferential direction of the central impression cylinder, has a linear thermal expansion coefficient of less than $2\times10^{-6}$ $K^{-1}$, and the central impression cylinder includes a part which radially supports the cylinder body from inside, and the part is made of a material which, in a radial direction, has a linear thermal expansion coefficient of less than $2\times10^{-6}$ $K^{-1}$.

20. Printing machine according to claim 19, wherein the part of the central impression cylinder which supports the cylinder body radially from inside is formed by disks.

* * * * *